US007407371B2

(12) United States Patent
Leone et al.

(10) Patent No.: US 7,407,371 B2
(45) Date of Patent: Aug. 5, 2008

(54) CENTRIFUGAL MULTISTAGE PUMP

(76) Inventors: Michele Leone, Via Giovanni Caboto, 11-Marina di Pisa, 56013 Pisa (IT); Aleesandro Santoni, Via Francesco Goha, 2-Ghezzano, 56010 S. Giuliano Terme (IT); Marco Trovi, Via Enrico De Nicola, 162, 56025 Pontedera (IT); Giancarlo Roggiolani, Via Del Muschio, 31, 58043 Castiglione della Pescaia (IT); Paul Craig Mellinger, 3380 SW. 11th Ave., Ft. Lauderdale, FL (US) 33315; Melvyn Wayne Mellinger, 3380 SW. 11th Ave., Ft. Lauderdale, FL (US) 33315; Mark Wayne Mellinger, 3380 SW. 11th Ave., Ft. Lauderdale, FL (US) 33315; Case Crowther, 825 NW. 6th Ave., Dania Beach, FL (US) 33004

( * ) Notice: Subject to any disclaimer, the term of this patent is extended or adjusted under 35 U.S.C. 154(b) by 491 days.

(21) Appl. No.: 10/975,943

(22) Filed: Oct. 28, 2004

(65) Prior Publication Data

US 2005/0095150 A1 May 5, 2005

Related U.S. Application Data

(60) Provisional application No. 60/515,472, filed on Oct. 29, 2003.

(51) Int. Cl.
*F04B 35/04* (2006.01)
*F04B 17/00* (2006.01)

(52) U.S. Cl. ..... 417/423.15; 417/423.1

(58) Field of Classification Search ..... 417/423.1, 417/423.15

See application file for complete search history.

(56) References Cited

U.S. PATENT DOCUMENTS

| | | | | |
|---|---|---|---|---|
| 4,998,865 | A | 3/1991 | Nakanishi et al. | |
| 5,141,410 | A | 8/1992 | Fujii | |
| 5,454,697 | A | 10/1995 | Nakanishi | |
| 5,961,293 | A | 10/1999 | Clemmons et al. | |
| 6,579,078 | B2 * | 6/2003 | Hill et al. | 417/423.7 |
| 6,626,652 | B2 * | 9/2003 | Koyama et al. | 417/423.1 |
| 6,634,853 | B1 * | 10/2003 | Anderson | 415/70 |
| 7,063,519 | B2 * | 6/2006 | Agrawal et al. | 417/423.1 |
| 2002/0159906 | A1 | 10/2002 | Phallen et al. | |
| 2003/0091443 | A1 * | 5/2003 | Sabini et al. | 417/53 |

* cited by examiner

*Primary Examiner*—Devon Kramer
*Assistant Examiner*—Patrick Hamo
(74) *Attorney, Agent, or Firm*—Buskop Law Group, PC; Wendy Buskop

(57) ABSTRACT

A centrifugal multistage stage pumps described herein. The centrifugal multistage pump includes a pump body having a longitudinal axis, an inlet for receiving a fluid from a first location and an outlet for discharging a pressurized fluid to a second location and a hydraulic assembly disposed within the pump body and adapted to pressurize the fluid. The pump further includes a motor, a first circuit board inverter disposed within the pump body, a microcontroller disposed on the first circuit board inverter, a pressure transducer disposed within the pump body, a heat sink adjacent the first circuit board inverter, a control panel connected to the circuit board inverter and the microcontroller. The pump has a mounting system adapted for rotation of the pump body around the longitudinal axis. In addition, the pump includes software imbedded within the memory, wherein the software includes protection, monitoring and control the features of the pump.

34 Claims, 7 Drawing Sheets

CENTRIFUGAL MULTISTAGE PUMP

The present application claims priority to co-pending U.S. Provisional Patent Application Ser. No. 60/515,472 filed on Oct. 29, 2003.

FIELD

Embodiments of the invention relate to centrifugal multistage pumps.

BACKGROUND

Appliances and other electrical devices are putting an ever increasing demand on the power systems in portable vessels and alternatively powered structures. These vessels can be motor homes, ships, drilling platforms, planes and other transportation, as well as buildings supplied by solar panels or windmills.

The appliances include pumps with high pressure and high flow characteristics. The appliances require standard alternating current electrical connections that continuously provide any amount of power required. The portable vessels are generally supplied by electric, photovoltaic, aeolic or similar generating sets which operate in discontinuous states and therefore use electric accumulators, typically lead batteries to provide power when the power generating devices are not generating power.

The discontinuous operating power generators and low voltage electrical accumulators generally provide sufficient power (12V or 24V direct current (DC)) to supply most electrical loads, such as for illumination, televisions and refrigerators but not for pumps with high pressure and high flow characteristics.

When discontinuous power generators are applied to water pumps, the generators can only supply small permanent magnet DC motors that use brush technology. The motors have a rated power of about 10 W to about 150 W. The small motors are matched to small pumps. While it is possible to operate the small pumps in this manner, this method of pump operation is generally expensive and inefficient.

Therefore, there is a need for a centrifugal multistage pump capable of operating on direct current in an inexpensive and more efficient manner while maintaining the high pressure and high flow characteristics of a pump powered by alternating current.

A need exists for a pump that has quiet operation, built in circuits for protecting the pump from damage and can be easily installed.

This invention meets these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments and that it can be practiced or carried out in various ways.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the pertinent art to make and use the inventions, when the information in this patent is combined with available information and technology. Various terms as used herein are defined below. To the extent a term used in a claim is not defined below, it should be given the broadest definition persons in the pertinent art have given that term as reflected in printed publications and issued patents.

The multi stage pump can be used in various applications, including a saltwater pressure system for live bait wells, salt water flush toilets, or mud blasting anchor washdowns.

Figure 1:
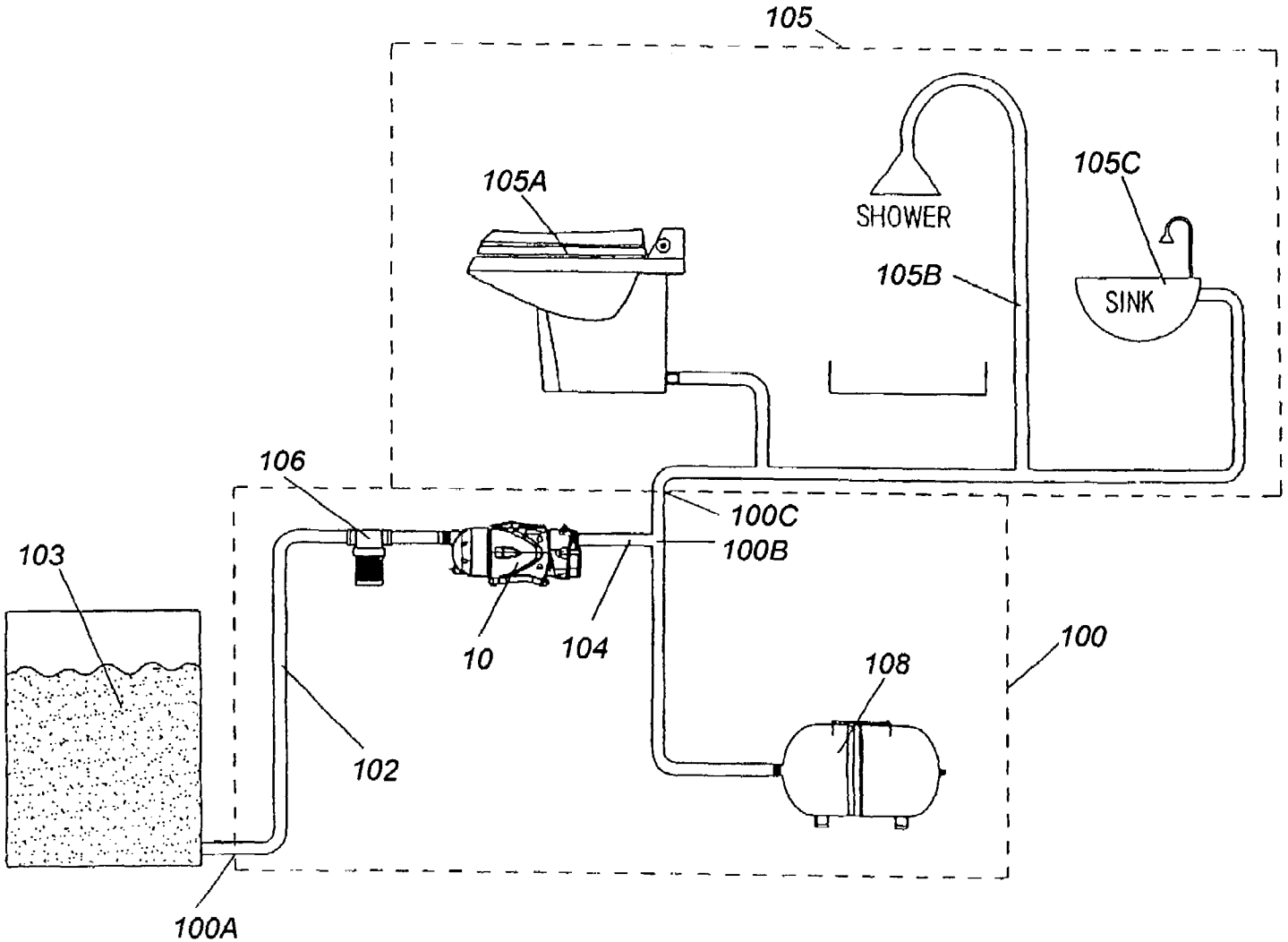
FIG. 1 illustrates a fluid transfer system.

FIG. 1 illustrates a fluid transfer system 100. The fluid transfer system 100 generally includes a centrifugal multistage pump 10, as described in further detail below. The fluid transfer system 100 further includes a holding tank 103 for holding the fluid operably connected to the pump 10 via a first conduit holding a pressurized fluid 102. The system 100 further includes an inlet 100A for receiving the pressurized fluid 102, a manifold 100B for passing the pressurized fluid 104 to a second location 105 and an outlet 100C for receiving the pressurized fluid operably connected to the manifold 100B.

The pump 10 is generally configured to receive a pressurized fluid 102 from a first location 103, which is further pressurized within the pump 10 to form a second pressurized fluid 104. The second pressurized fluid 104 is then sent to a second location 105A, 105B or 105C, for example. Optionally, a strainer 106 can be included and operably connected to the pump 10.

The fluid transfer system 100 can further include a holding tank 108 for holding fluid, an inlet for receiving a pressurized fluid 102, a manifold for passing the fluid to a second location 105, an outlet for receiving waste, a first conduit and a second conduit.

In one embodiment, the inlet is a ¾ inch threaded pipe. In another embodiment, the first conduit includes an inlet check valve.

Embodiments of the invention further include a method for pumping fluid from a vessel. The method generally includes introducing fluid to a fluid inlet, passing at least a portion of the fluid from the fluid inlet to a centrifugal multistage pump, combining at least a portion of the fluid with a waste product to form a waste stream, passing at least a portion of the waste stream through a conduit to a holding tank and discharging at least a portion of the waste stream from the vessel through the outlet.

An example of a vessel includes a RV, a boat or a subsea platform.

Figure 2:
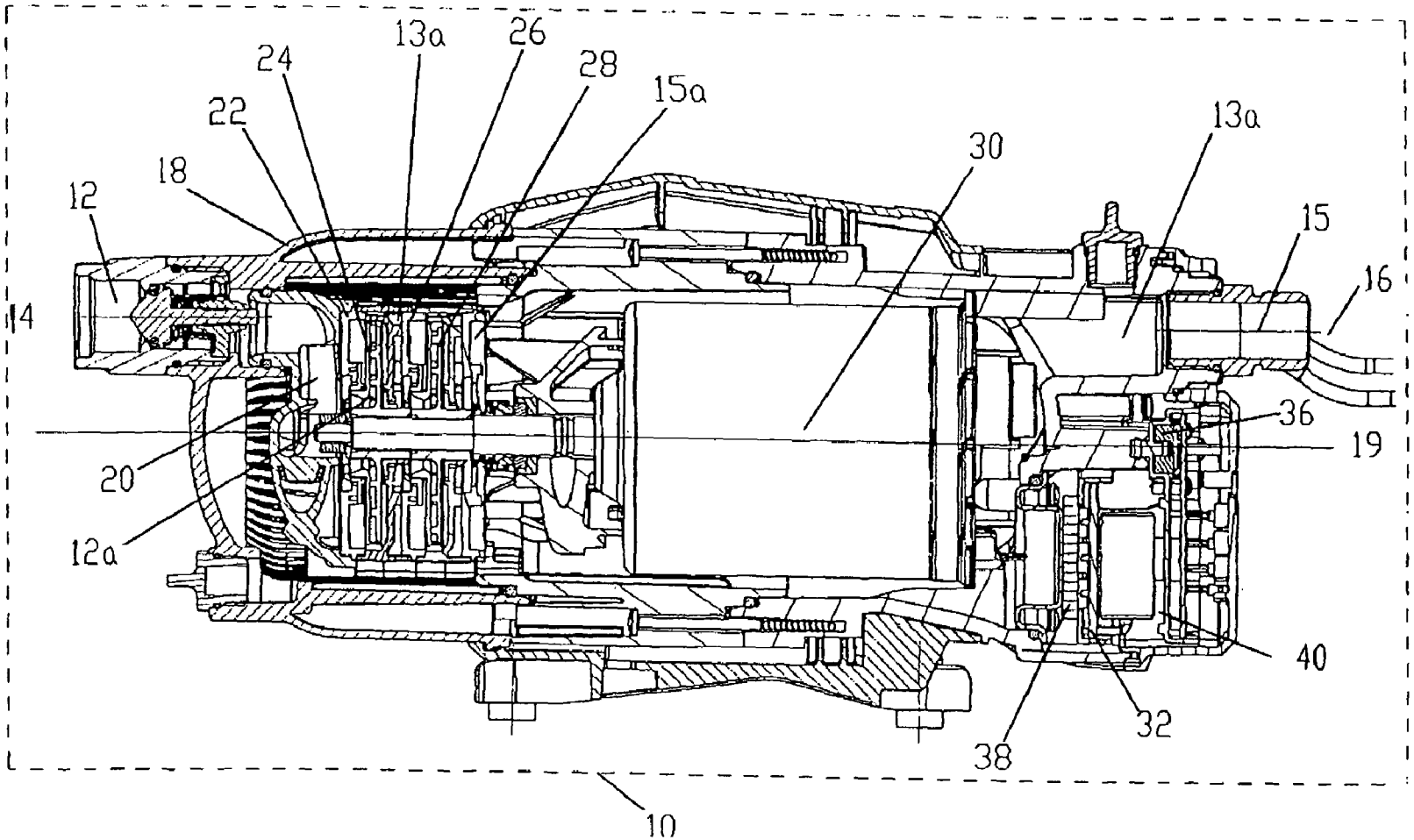
FIG. 2 illustrates a centrifugal multistage pump.

FIG. 2 illustrates the centrifugal multistage stage pump 10.

The centrifugal multistage pump 10 generally includes a pump body 18. The pump body includes a longitudinal axis 19, an inlet 12 for receiving a fluid 12*a* from a first location 14 and an outlet 15 for discharging a pressurized fluid 15*a* to a second location 16. The fluid 12*a* can be a variety of fluids, such as water, waste or a food product. The first location 14 can be a floating vessel and the second location can be an ambient location for example.

The centrifugal multistage pump 10 further includes a hydraulic assembly 20 disposed within the pump body 18 and adapted to pressurize the fluid 12*a* to form a pressurized fluid 13*a*. The hydraulic assembly 20 generally includes a first diffuser 22 having a first impeller 24 and a second diffuser 26 having a second impeller 28. The first diffuser 22 and the second diffuser 26 are generally enclosed within a casing to form the hydraulic assembly 20. The fluid 12*a* flows centrifugally from the first diffuser 22 to the second diffuser 26. The formed pressurized fluid 15*a* is then moved radially outwards from a periphery of the second impeller 28 to the pump body 18.

A motor 30 is operably connected to the first impeller 24 and the second impeller 28. In one embodiment, the motor is a three phase motor. In yet another embodiment, the motor is an asynchronous induction, one, two or three phase 10 to 60 volt AC brushless motor. Preferably the motor can detect the initial voltage applied and adjust to the operate on the voltage applied. In one embodiment, the motor has a power rating of less than 1000 watts. For example, the motor can have a power rating of 500 watts. The motor can have various power settings and the power settings can be changed from a control panel.

Further, a circuit board inverter 32 is disposed within the pump body 18 and in communication with the motor 30. In one embodiment, the centrifugal multistage pump includes at least two circuit board inverters. In another embodiment, at least two circuit board inverters are operably connected by a pin. In yet another embodiment, the circuit board inverter is pleated. In another embodiment, the circuit board inverter includes a 24 volt DC inverter, a 12 volt DC inverter or a 9 volt AC inverter.

A microcontroller (not shown) is disposed on the circuit board inverter 32.

The centrifugal multistage pump 10 further includes a pressure transducer 36 disposed within the pump body 18 and a heat sink 38 adjacent the first circuit board inverter 32 adapted for removing heat from the first circuit board inverter 32 and transferring it to the pressurized fluid 15*a*. In one embodiment, the pressure transducer is formed of a ceramic material. In yet another embodiment, the pressure transducer includes a speed controller. The pressure transducer 36 is generally configured to monitor the output pressure of the pump and send the information to the circuit board.

In addition, a control panel 40 is operably connected to the circuit board inverter 32 and the microcontroller 34. In one embodiment, the control panel includes at least one switch and at least one LED. The motor can automatically recognize the input voltage and convert either 10 to 60 volt DC or 10 to 60 volt AC three phase power to a useable motor voltage. The control panel can receive input information from the pressure transducer and be used to program the operational characteristics of the pump.

Figure 3:
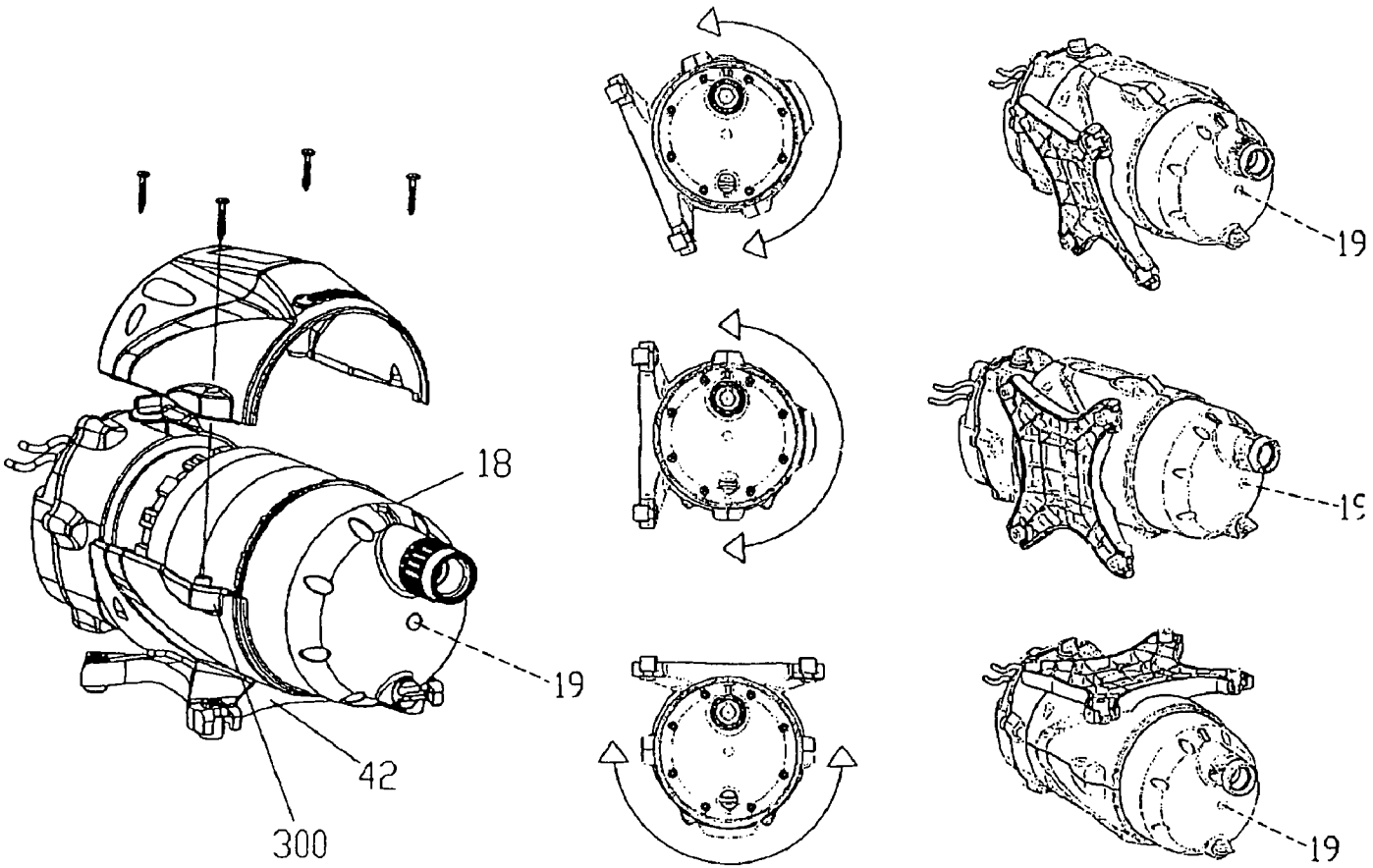
FIG. 3 illustrates a mounting system.

The centrifugal multistage pump can be mounted on an object or within a system by a mounting system 42, as shown in FIG. 3, adapted for rotation of the pump body 18 around the longitudinal axis 19. In one embodiment, the mounting system 42 is unshaped and in two pieces for ease in mounting and rotation of the pump body 18. In another embodiment, the opening 300 of the mounting system 42 has a diameter of from about 4 inches to about 6 inches.

In one embodiment, the mounting bracket is formed of two molded parts designed to wrap around the circumference of the cylindrical pump body. The bottom part has the mounting feet used to secure the pump to a horizontal or vertical surface with fasteners, such as screws, and a 180 degree cradle to receive the cylindrical body of the pump. The top is a cover that wraps around the other half of the cylindrical pump body and is secured to the bottom mounting bracket with screws. Molded into the cylindrical pump body are several female pockets designed to receive the male protrusions molded into both parts of the mounting bracket. The interference fit of the two halves of the bracket into the pump body provide a sturdy and reliable mounting system that will not allow the cylindrical pump body to rotate due to excessive vibration, static or dynamic loads.

Figure 4:
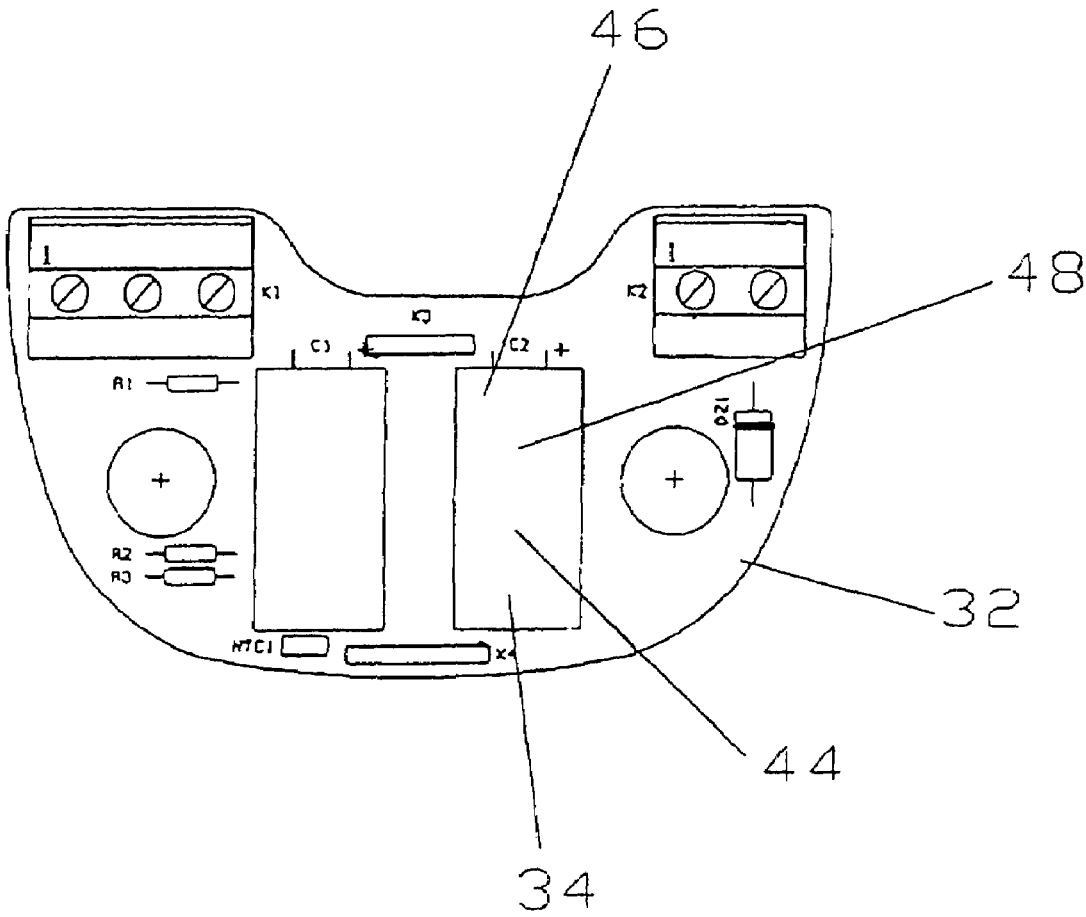
FIG. 4 illustrates a circuit board inverter.

FIG. 4 illustrates a circuit board inverter 32 with a microcontroller 34 disposed thereon. The microcontroller 34 generally includes an operating system 44 and software 48 stored in the memory 46 and the microcontroller is adapted to control the motor 30.

Figure 5:
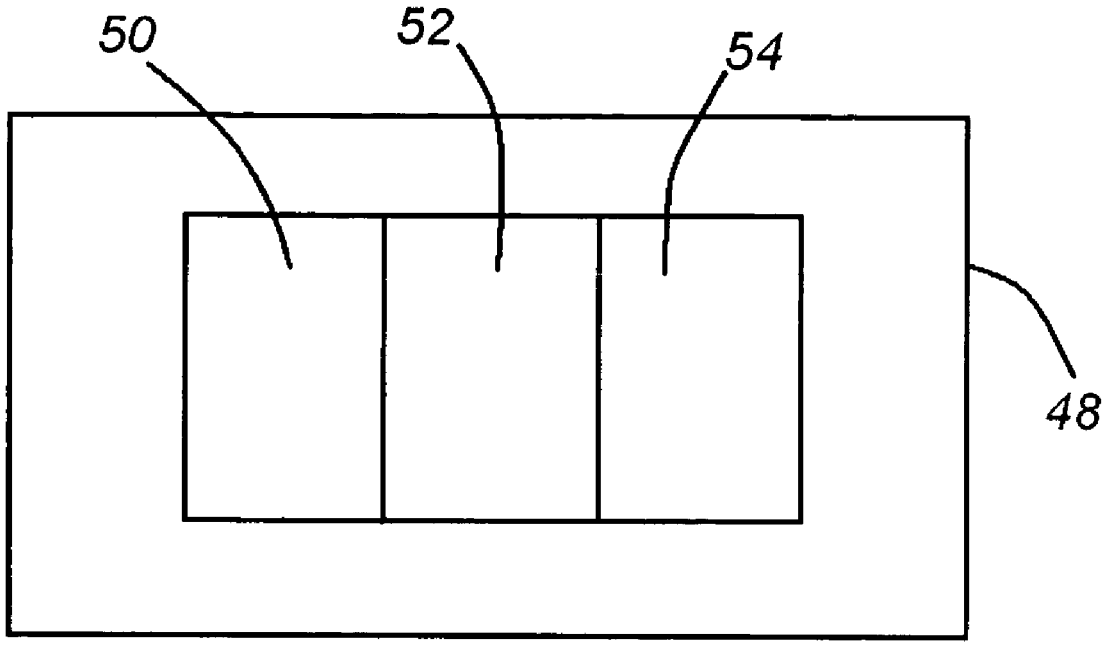
FIG. 5 illustrates software.

FIG. 5 further illustrates the software 48, which includes protection features 50 adapted for emergency shutoff in the case of a dry run, overvoltage, undervoltage, over pressurization or flooding. The software 48 also has monitoring features 52 adapted for monitoring pressure, temperature and power levels. The software 48 also has control features 54 adapted for control of the motor speed, the starting of the motor and the stopping of the motor. In one embodiment, the control features include power settings. In another embodiment, control features include a variance feature adapted for varying the revolutions per minute providing for constant power. Preferably, the revolutions per minute are from about 6000 to about 7000.

Another embodiment of the invention includes a low vibration, high revolutions per minute (RPM) low decibel pump, resulting in a quiet pump. This pump includes many of the features described above in addition to a number of other features described below. For example, the pump includes a low decibel hydraulic assembly disposed within the pump body and adapted to pressurize the fluid to form a pressurized fluid. The impellers of the hydraulic assembly are configured to impart very little hydraulic noise to the pump. The impellers can be a multi-stage self-priming system. Further, the motor operates at a high RPM to reduce structure born vibration and is surrounded by a water-cooling system that impends the transmission of airborne motor noise.

The pump can be made of corrosion resistant materials such as stainless steel, or other materials capable of withstanding the corrosion, from various fluids such as saltwater.

The pumps described herein generally are evaluated under performance criteria, such as head, delivery, efficiency, noiselessness, reliability and life expectancy, which have been far superior to DC pumps known to one skilled in the art.

In one embodiment, the pump includes a three phase induction motor with very low voltage and about 500 W of rated power. The rated power is supplied by a solid state switching device configured to not generate electric arcs. In addition, the pump includes brushless technology providing considerable advantages in safety and costs because brushes can spark during normal operation and wear generally limits the life expectancy of the motor.

Preferably, the motor is cooled by the fluid passing through the pump. Cooling of the motor is especially important because the motor experiences high currents producing heat. Therefore, a dissipater cooled by the fluid is included in the pump, therefore avoiding the traditional systems that, although simpler, would have caused a considerable increase in the dimensions of the innovation and a complete alteration of its design.

In addition, the use of three phase motors with frequency inverters operating at higher frequencies than the traditional electric network inverters, makes it possible to multiply the motor's efficiency and to reduce almost proportionally its dimensions and weight. This reduction in dimensions and weight is advantageous in mobile applications (motor home, marine . . . ) where requirements are particularly important, and, sometimes, even binding.

In this embodiment, the pump includes a metallic or composite impeller having metallic or composite diffusers, and which is operated by an induction three phase or two phase motor. The motor generally has windings that are supplied by alternate current with effective tension values equal or inferior to the direct tension of the chosen battery (12V or 24V battery), and with frequency equal or superior to the normal network tensions, for example 100 Hz.

A frequency inverter is composed of 6 power MOS or bipolar transistors, controlled by a microcontroller by means of integrated or discrete drivers, to divide the direct current between the motor's three phases using sinusoidal modulated impulses. The sinusoid has the same frequency upon each of the three phases but is being dephased by 120 electrical degrees from phase one to phase two, from phase two to phase three and from phase three to phase one. Therefore, the divided frequency is higher than the modulated sinusoid thus inductance of the motor's stator must be sufficiently high to integrate the impulses of tension applied to each phase. As a result, each phase results in an approximately sinusoidal current whose value is proportional to the duration of the impulse.

Figure 6:
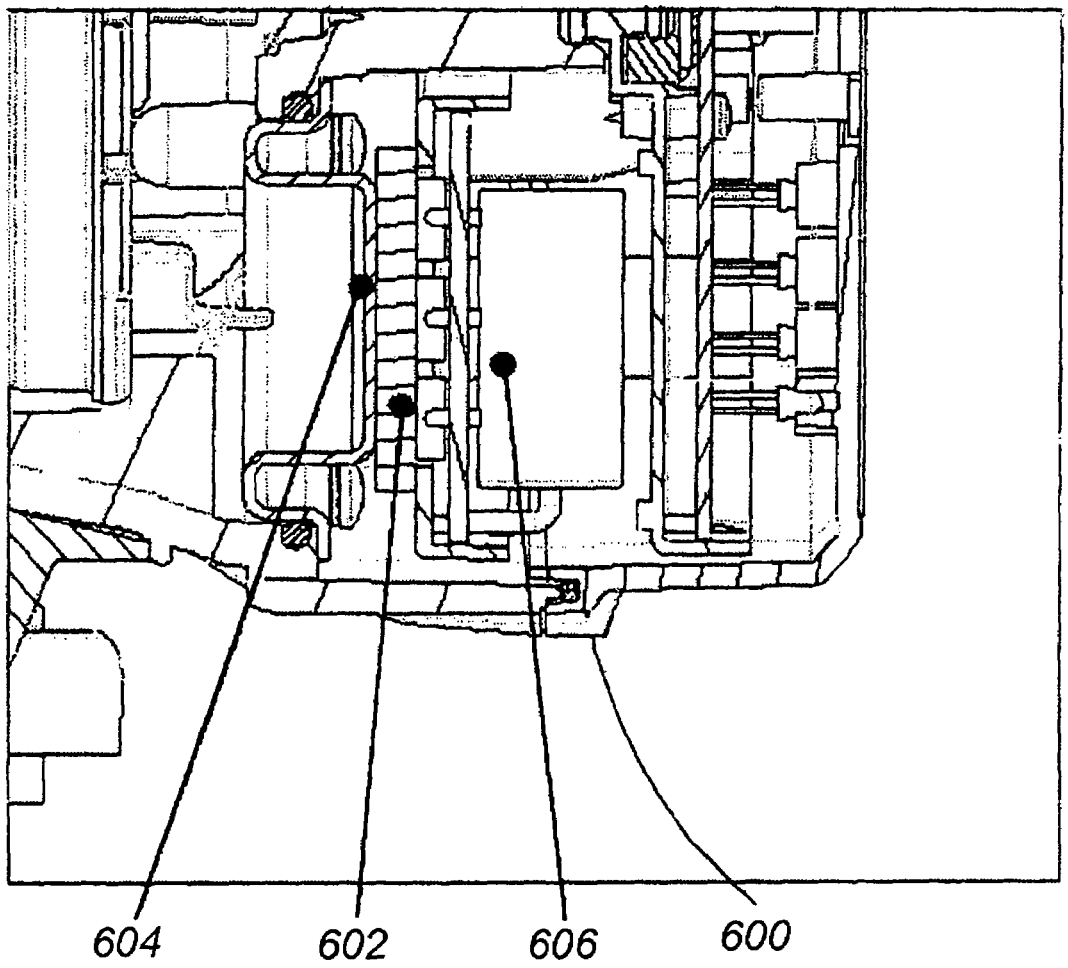
FIG. 6 illustrates an embodiment of a heat sink.

The power MOS or bipolar transistor further includes a three phase contactor for the motor's supply system so that no other switching device is needed. The power transistors 606 are cooled indirectly by pressurized fluid passing over a heat sink 600 (shown in FIG. 6), which is in thermal contact with water.

In this embodiment, the heat sink 600 is composed by a copper or aluminum plate 602 in contact on one side with the printed circuit board. The other side of the heat sink is directly in contact with the fluid pumped through the pump or through a stainless steel plate 604 screwed to the pump's cover.

To limit the contact resistance and to aid heat circulation among the parts of the heat sink, a special paste can be interposed between the printed circuit board and the heat sink system.

The thicknesses and shape of the heat sink have been calculated to optimize the thermal exchange, with regard to the static and assembly requirements as well.

The microcontroller's software calculates the duration and the synchronization of impulses to obtain three phase currents having the appropriate frequency and amplitude values for the pump's resistance couple. The couple determined according to set regulating algorithms which are generally a function of the pump's head, angular rotation speed and delivery. The algorithms can include an automatic pump start in the presence of delivery or lack of pressure in the water distribution network, or automatic pump OFF in the presence of pressure or lack of delivery. The algorithms can also include pump supply up to the beginning of its priming functions during the pump's first start and after every lack of supply tension, limitation of the priming time in case of lack of water on the suction side, and limitation of the pump's head by modulating the motor's angular speed in relation to the present pressure signal. The algorithms can further include limitation of the pump's functioning in relation to temperature, dry run protection, protection against piping breakings, an alarm for under/over voltage, power control, protection against overcurrent and LED management.

In this embodiment, the pump can be positioned either horizontally or vertically. The pump is equipped with a "Variable Angle Fixing System" that allows its setting on both horizontal (floors and coverings) and vertical walls. The pump can also be rotated along the longitudinal axis. The "Variable Angle Fixing System" design enables the end user to directly perform the setting operations.

The integrated pressure transducer can generate an electric signal that is a function of the pressure created by the water. The electric signal allows the microcontroller to operate automatic start and stop cycles and to modulate the frequency and amplitude of the motor's supply tension. Doing so regulates the output pressure of the system in any flow condition, therefore optimizing energy consumption.

Further, the above mentioned algorithm detects any lack of water on the suction side of the system by controlling current and output pressure, thus when the absorbed current is abnormally low and the output pressure is low it stops the motor after a given number of start and priming trials.

Further, in one embodiment, starts and stops are operated in a progressive manner, i.e., through frequency ramps which produce a constant acceleration and deceleration of the motor until the final speed of the motor is reached.

Further, the microcontroller measures the supply tension and automatically compensates the division to impose to the motor the same sinusoidal current of the available direct current.

The microcontroller can also measure water temperature through a temperature sensor and start the pump when the temperature is about 0° C. causing an intentional increase in water temperature due to the pump's mechanical energy transformation in thermal energy, assuring therefore an efficient protection against the fluid in the pump freezing and damaging the pump.

Further, the microcontroller measures water temperature through a temperature sensor and stops the pump when the temperature is over a set value, assuring therefore an efficient protection against over heating and damaging the pump.

Figure 7:
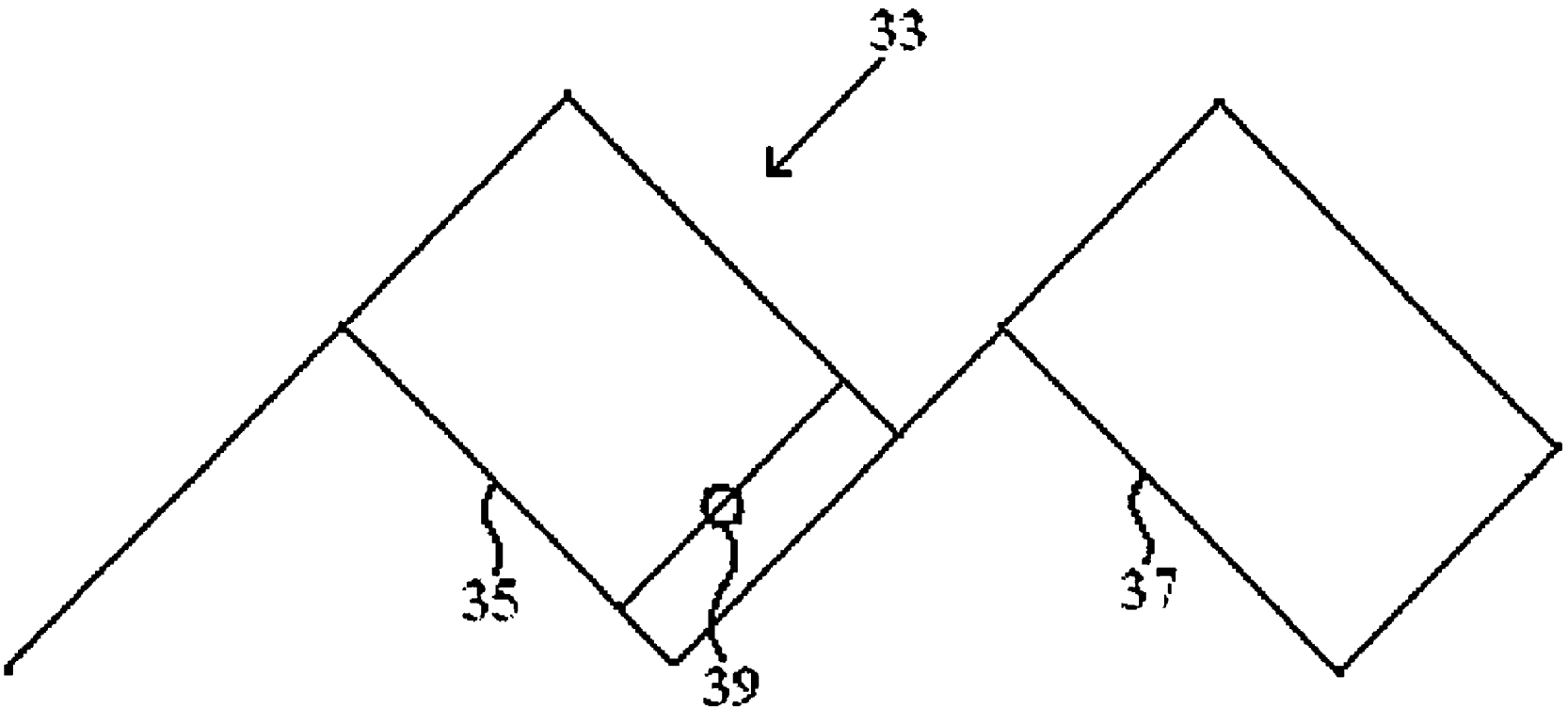
FIG. 7 illustrates a pleated circuit board inverter.

FIG. 7 depicts an embodiment of a circuit board inverter 33 that is pleated. The pleated circuit board inverter 33 can have substantially similar elements and features as the circuit board inverter 32, depicted in FIG. 4. The circuit board inverter 33 includes a first circuit board 35 and a second circuit board 37, which are connected by a pin 39.

While these embodiments have been described with emphasis on the preferred embodiments, it should be understood that within the scope of the appended claims, the embodiments might be practiced other than as specifically described herein.

What is claimed is:

1. A centrifugal multistage stage pump adapted to use between 10 and 60 volts of input DC power comprising:

a. a pump body comprising a longitudinal axis, an inlet for receiving a fluid from a first location and an outlet for discharging a pressurized fluid to a second location;

b. a hydraulic assembly disposed within the pump body and adapted to pressurize the fluid to form the pressurized fluid, wherein the hydraulic assembly comprises:
   i. a first diffuser comprising a first impeller; and
   ii. a second diffuser comprising a second impeller, wherein the pressurized fluid flows centrifugally from the first diffuser to the second diffuser;
c. an induction motor operably connected to the first impeller and the second impeller;
d. a first circuit board inverter disposed within the pump body;
e. a microcontroller disposed on the first circuit board inverter, wherein the microcontroller comprises an operating system with memory and is adapted to control the induction motor;
f. a pressure transducer disposed within the pump body;
g. a heat sink adjacent the first circuit board inverter adapted for removing heat from the first circuit board inverter and transferring it to the pressurized fluid;
h. a control panel operably connected to the first circuit board inverter and the microcontroller;
i. a mounting system adapted for rotation of the pump body around the longitudinal axis; and
j. software imbedded within the memory comprising:
   i. protection features adapted for emergency shutoff;
   ii. monitoring features adapted for monitoring pressure, temperature and power levels; and
   iii. control features adapted for control of motor speed, start and stop of motor.

2. The centrifugal multistage pump of claim 1, wherein the fluid comprises water, waste, a food product or combinations thereof.

3. The centrifugal multistage pump of claim 1, wherein the first location is a floating vessel.

4. The centrifugal multistage pump of claim 1, wherein the second location is an ambient location.

5. The centrifugal multistage pump of claim 1, wherein the pressurized fluid is moved radially outwards from a periphery of the second impeller to the pump body.

6. The centrifugal multistage pump of claim 1 further comprising at least two circuit board inverters.

7. The centrifugal multistage pump of claim 6, wherein the at least two circuit board inverters are operably connected by a pin.

8. The centrifugal multistage pump of claim 1, wherein the first circuit board inverter is pleated.

9. The centrifugal multistage pump of claim 1, wherein the control panel comprises at least one switch and at least one LED.

10. The centrifugal multistage pump of claim 1, wherein the motor is a three phase motor.

11. The centrifugal multistage pump of claim 1, wherein the motor is an asynchronous induction one, two or three phase 10 to 60 volt AC brushless motor.

12. The centrifugal multistage pump of claim 1, wherein the first circuit board inverter comprises a DC to a one, two or three phase AC inverter.

13. The centrifugal multistage pump of claim 1, wherein the pressure transducer is formed of a ceramic material.

14. The centrifugal multistage pump of claim 1, wherein the pressure transducer comprises a speed controller.

15. The centrifugal multistage pump of claim 1, wherein the control features comprise power settings.

16. The centrifugal multistage pump of claim 1, wherein the protection features comprise a dry run feature, an over voltage feature or combinations thereof.

17. The centrifugal multistage pump of claim 1, wherein the control features include a variance feature adapted for varying the revolutions per minute providing for constant power.

18. A low vibration, high frequency and low decibel pump using between 10 volts and 60 volts DC comprising:
a. a pump body comprising a longitudinal axis, an inlet for receiving a fluid from a first location and an outlet for discharging a pressurized fluid to a second location;
b. a low decibel hydraulic assembly disposed within the pump body and adapted to pressurize the fluid to form the pressurized fluid, wherein the hydraulic assembly comprises:
   i. a first diffuser comprising a first impeller; and
   ii. a second diffuser comprising a second impeller, wherein the pressurized fluid flows centrifugally from the first diffuser to the second diffuser and the impellers impart a high frequency to the pump;
c. an induction motor operably connected to the first impeller and the second impeller, wherein the induction motor imparts a low vibration to the pump;
d. a first circuit board inverter disposed within the pump body;
e. a microcontroller disposed on the first circuit board inverter, wherein the microcontroller comprises an operating system with memory and is adapted to control the induction motor;
f. a pressure transducer disposed within the pump body;
g. a heat sink adjacent the first circuit board inverter adapted for removing heat from the first circuit board inverter and transferring it to the pressurized fluid;
h. a control panel operably connected to the first circuit board inverter and the microcontroller;
i. a mounting system adapted for rotation of the pump body around the longitudinal axis; and
j. software imbedded within the memory comprising:
   i. protection features adapted for emergency shutoff;
   ii. monitoring features adapted for monitoring pressure, temperature and power levels; and
   iii. control features adapted for control of motor speed, start and stop of motor.

19. The low vibration, high frequency and low decibel pump of claim 18, wherein the fluid comprises water, waste, a food product or combinations thereof.

20. The low vibration, high frequency and low decibel pump of claim 18, wherein the first location is a floating vessel.

21. The low vibration, high frequency and low decibel pump of claim 18, wherein the second location is an ambient location.

22. The low vibration, high frequency and low decibel pump of claim 18, wherein the pressurized fluid is moved radially outwards from a periphery of the second impeller to the pump body.

23. The low vibration, high frequency and low decibel pump of claim 18, further comprising at least two circuit board inverters.

24. The low vibration, high frequency and low decibel pump of claim 23, wherein the at least two circuit board inverters are operably connected by a pin.

25. The low vibration, high frequency and low decibel pump of claim 18, wherein the first circuit board inverter is pleated.

26. The low vibration, high frequency and low decibel pump of claim 18, wherein the control panel comprises at least one switch and at least one LED.

27. The low vibration, high frequency and low decibel pump of claim 18, wherein the motor is a three phase motor.

28. The low vibration, high frequency and low decibel pump of claim 18, wherein the motor is an asynchronous induction one, two or three phase 10 to 60 volt AC brushless motor.

29. The low vibration, high frequency and low decibel pump of claim 18, wherein the first circuit board inverter comprises a DC to a one, two or three phase AC inverter.

30. The low vibration, high frequency and low decibel pump of claim 18, wherein the pressure transducer is formed of a ceramic material.

31. The low vibration, high frequency and low decibel pump of claim 18, wherein the pressure transducer comprises a speed controller.

32. The low vibration, high frequency and low decibel pump of claim 18, wherein the control features comprise power settings.

33. The low vibration, high frequency and low decibel pump of claim 18, wherein the protection features comprise a dry run feature, an over voltage feature or combinations thereof.

34. The low vibration, high frequency and low decibel pump of claim 18, wherein the control features include a variance feature adapted for varying the revolutions per minute providing for constant power.

* * * * *